US010775007B2

(12) United States Patent
Cao et al.

(10) Patent No.: US 10,775,007 B2
(45) Date of Patent: Sep. 15, 2020

(54) SPLIT TYPE DOWNLIGHT APPARATUS

(71) Applicant: LEEDARSON LIGHTING CO. LTD., Zhangzhou, Fujian (CN)

(72) Inventors: Liangliang Cao, Fujian (CN); Xiaojuan Huang, Fujian (CN)

(73) Assignee: LEEDARSON LIGHTING CO. LTD., Zhangzhou, Fujian (CN)

( * ) Notice: Subject to any disclaimer, the term of this patent is extended or adjusted under 35 U.S.C. 154(b) by 0 days.

(21) Appl. No.: 15/927,063

(22) Filed: Mar. 20, 2018

(65) Prior Publication Data

US 2018/0306393 A1 Oct. 25, 2018

(30) Foreign Application Priority Data

Apr. 25, 2017 (CN) ..... 2017 2 0439129 U

(51) Int. Cl.

| | |
|---|---|
| ***F21S 8/02*** | (2006.01) |
| ***F21V 17/12*** | (2006.01) |
| ***F21V 21/04*** | (2006.01) |
| ***F21V 21/13*** | (2006.01) |
| ***F21V 29/76*** | (2015.01) |
| ***F21V 23/06*** | (2006.01) |
| *F21Y 115/10* | (2016.01) |

(52) U.S. Cl.

CPC ..... *F21S 8/026* (2013.01); *F21V 17/12* (2013.01); *F21V 21/04* (2013.01); *F21V 21/13* (2013.01); *F21V 23/06* (2013.01); *F21V 29/763* (2015.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 5,585,697 | A * | 12/1996 | Cote | F21S 8/00 250/205 |
| 8,395,304 | B2 * | 3/2013 | Hisayasu | F21V 19/004 313/46 |
| 8,760,042 | B2 * | 6/2014 | Sakai | F21V 23/002 313/324 |
| 2002/0024814 | A1 * | 2/2002 | Matsuba | F21V 29/004 362/294 |
| 2010/0026157 | A1 * | 2/2010 | Tanaka | F21V 19/0055 313/45 |
| 2010/0219735 | A1 * | 9/2010 | Sakai | F21V 23/002 313/46 |
| 2011/0063842 | A1 * | 3/2011 | Takei | F21V 19/004 362/249.01 |

(Continued)

*Primary Examiner* — Elmito Breval

(74) *Attorney, Agent, or Firm* — Chun-Ming Shih; LanWay IPR Services

(57) ABSTRACT

A split type downlight apparatus includes a lamp cap, a driving component, a light body assembly, a spring and an electrical connector. The light body assembly includes a light shell and a light assembly fixed in the light shell. One end of the electrical connector electrically connects to the driving component. The other end of the electrical connector electrically connects to the light assembly. Two ends of the spring are hooked in the bottom of the driving housing and the top of the light shell respectively. The driving housing connects to the light shell through the spring. The driving board and the light assembly are separated.

19 Claims, 7 Drawing Sheets

(56) References Cited

U.S. PATENT DOCUMENTS

| | | | | |
|---|---|---|---|---|
| 2011/0068674 | A1* | 3/2011 | Takenaka | F21K 9/23 313/318.07 |
| 2011/0074271 | A1* | 3/2011 | Takeshi | F21V 19/004 313/46 |
| 2011/0075423 | A1* | 3/2011 | Van De Ven | F21V 17/02 362/249.02 |
| 2013/0257278 | A1* | 10/2013 | DeVore | H01J 5/54 315/113 |
| 2013/0294109 | A1* | 11/2013 | Athalye | H01R 13/6658 362/650 |
| 2013/0301261 | A1* | 11/2013 | Chou | F21K 9/238 362/235 |
| 2014/0126220 | A1* | 5/2014 | Chen | F21V 17/164 362/311.02 |
| 2014/0254199 | A1* | 9/2014 | Athalye | F21V 23/006 362/650 |
| 2015/0070910 | A1* | 3/2015 | Yang | F21V 19/045 362/363 |
| 2016/0018087 | A1* | 1/2016 | Gielen | F21V 17/005 362/249.01 |
| 2017/0122534 | A1* | 5/2017 | Ticktin | F21V 21/22 |

* cited by examiner

SPLIT TYPE DOWNLIGHT APPARATUS

FIELD OF INVENTION

The present invention relates to a downlight, and particularly to a split type downlight apparatus.

BACKGROUND

At present, there are many different types of downlight devices on the market. The downlight devices basically meet users' requirements, but there are still some deficiencies. Most downlight devices have lamp caps connected to light bodies through terminals, thus the heat dissipation of downlight devices is unsatisfactory. As downlight devices usually need to continuously work for a long time, the temperature of light bodies increases, which can shorten the life of downlight devices. Because of a large number of downlight components, the production process and method of installation are complicated, and the production costs increase.

SUMMARY OF INVENTION

In order to solve the above technical problems, a split type downlight apparatus according to the present invention includes a lamp cap, a driving component, a light body assembly, a spring and an electrical connector. The driving component includes a driving housing and a driving board fixed in the driving housing. The lamp cap is fixed on the driving housing. The lamp cap electrically connects to the driving board.

The light body assembly includes a light shell and a light assembly fixed in the light shell. One end of the electrical connector electrically connects to the driving component. The other end of the electrical connector electrically connects to the light assembly. Two ends of the spring are hooked in the bottom of the driving housing and the top of the light shell respectively. The driving housing connects to the light shell through the spring.

In one embodiment, the driving housing includes an upper driving cover and a lower driving cover. The upper driving cover and the lower driving cover form a space. The driving board seated in the groove of upper driving cover is fixed in the space.

The lower driving cover has a first hole. A lead terminal is set in the driving board. One end of the electrical connector goes through the first hole and electrically connects to the lead terminal.

In one embodiment, the light body assembly further includes a translucent cover. The light shell has a space in which the light assembly is fixed. The translucent cover is fixed on the light shell. The translucent cover seals the entrance of the space.

A plate with second hole is set on the top of the light shell. The light assembly is provided with an electrical terminal. The other end of the electrical connector goes through the second hole and electrically connects to the electrical terminal.

In one embodiment, the lamp cap includes an insulating cap set on the top and side walls connected to the insulating cap. There is an assembling hole on the central of the insulating cap.

In one embodiment, a positive pole terminal and a negative pole terminal are set on one end of the driving board.

In one embodiment, a conductive pin is set in the lamp cap. While assembling, one end of the conductive pin goes through the assembling hole and electrically connects to the positive pole terminal. The other end of the conductive pin is fixed on the top of the lamp cap. The negative pole terminal electrically connects to the side walls of the lamp cap.

In one embodiment, the upper driving cover is provided with an external screw thread for fixing, and the lower driving cover is provided with an internal screw thread hole. The internal screw thread hole corresponds to the external screw thread. The upper driving cover is fixed to the lower driving cover through corresponding of the external screw thread and the internal screw thread hole.

In one embodiment, there is a plate set on the top of the light shell. The lower driving cover is provided with first fixing ring. The plate of the light shell is provided with second fixing ring. Two ends of the spring are provided with hooks. Two ends of the spring are hooked in the first fixing ring and second fixing ring respectively.

In one embodiment, the first fixing ring is integrated formed with the lower driving cover, and the second fixing ring is integrated formed with the plate.

Compared with prior art, the advantages of the present invention are shown below:

In present invention, the driving board is set in the driving housing. The light assembly connects to the light shell through a spring. The driving board and the light assembly are separated. Therefore, the heat dissipation is improved; the lifespan of the driving board and light assembly are longer. The driving component and light body assembly could be produced respectively and then assembled together. The present invention simplifies production process and reduces production costs.

The driving board electrically connects to the light assembly through the electrical connector. The installation processes are as follows: insert two ends of the light assembly into the driving board and light assembly terminal; hook two ends of the spring on the driving housing and light shell respectively; screw the lamp cap into the lamp holder. The downlight is simple and easy to assemble. When the downlight is broken, check the driving component and light body assembly respectively, which is easy to repair.

According to another embodiment of the present invention, a downlight apparatus has a driver module, a light module and a flexible component.

The driver module has a driver housing and a driver circuit. The driver circuit converts an external power to a driving current. The driver housing has a bottom cover.

The light module has a LED module, a light housing, and a front panel. The front panel has a surface ring with a top side facing to a ceiling to be installed. The front panel has an opening for outputting light of the LED module. The light housing has a top cover being kept a distance from the bottom cover of the driver housing when the downlight apparatus is installed.

The flexible component is used for connecting the top cover of the light housing and the bottom cover of the driver housing. The term flexible component means the distance and relative positions between the light module and the driver module may be changed when the downlight apparatus is not installed to a ceiling. Therefore, the flexible component may be a spring, a bendable metal bar, one or more than one wires.

Please be noted that in alternative embodiments, the flexible component may be replaced with a spaced bracket, which may still keep the driver module and the light module with a predetermined distance while performing well for heat dissipation. Such embodiments may be divided as a continuation application of this application.

For example, a bracket with several tubes is for keeping the light module and the driver module with a distance. Most part of the bracket is empty, thus air may be moved easily for better heat dissipation.

Such bracket may be detachable from either the light module or the driver module or may be detachable completely from the light module and the driver module.

An example of the light module may refer to the light body assembly, but not limit to the light body assembly as mentioned above. For example, the light module may have different LED arrangement, e.g. arranged in a lateral wall and using a light guide to change light paths to desired output direction.

An example of the driver module may refer to the components enclosed with the driving housing, but not necessary limit to those examples. For example, the driver module may not need a cap, like an Edison cap to be connected to an external power source.

In some embodiments, the flexible component may have one or more spring components. Other variation, like elastic bar, may also be used as an alternative option.

In some embodiments, the spring may have an external insulated layer and conductive material inside the external insulated layer for transmitting the driving current to the LED module. For example, electricity wires may be enclosed by elastic material to form the flexible component mentioned here. The electricity wires may be separately enclosed by insulated material and form multiple connections between the light module and the driver module. Such design increases robust connection between the driver module and the light module. Multiple wires may be enclosed at the same with insulated material.

In some other embodiments, in addition to the spring, there may be wires for transmitting electricity from the driver module to the light module.

In some embodiments, the top cover of the light module has a first socket for inserting a first terminal end of the wire. Also, the bottom cover of the driver module may have a second socket for inserting a second terminal end of the wire.

In such case, the flexible component is easily detachable from the light module and the driver module. During installation, users just need to plug the flexible component into the sockets of the light module and the driver module.

In some embodiments, the light module is detachable from the driver module and is the replaceable with another light module with a different output light characteristic. In other words, the same driver module may be used to match several different light modules and vice versa.

For example, users may buy several light modules with different light beam angles and replace a necessary light module to meet their needs.

On the other hand, the driver module may have different components, even having additional components like wireless transmitter, audio circuit and control circuit. In such case, the same light module may match to different driver modules that may have different pricing for different needs. Such design would reduce significantly the manufacturing and storing cost.

In some embodiments, the flexible component includes one or more wires for providing both structure connection and electrical connection between the light module and the driver module. In other words, compared with previous examples, the spring may even be reduced.

In some embodiments, the surface ring, i.e. the part that has its top side facing and touching the ceiling and having its bottom side facing downwardly to users, may have corresponding fixing structures, like screw holes, screws, clips or other fasteners to fix to the ceiling. When the bottom part of the downlight apparatus, i.e. the light module is fixed to the ceiling, and its top part, i.e. the driver module is fixed to a socket or an installation box, the connection between the light module and the driver module does not need strong structure connection, e.g. only for transmitting electricity. This makes the overall product more robust and meeting safety standards.

In some embodiments, since most space between the light module and the driver module is empty, protruding structures like fins may be installed on either the top cover of the light module and/or the bottom cover of the driver module for better heat dissipation.

DETAILED DESCRIPTION

The following describes embodiments of a split type downlight apparatus according to the present invention with reference to the drawings.

Figure 1:
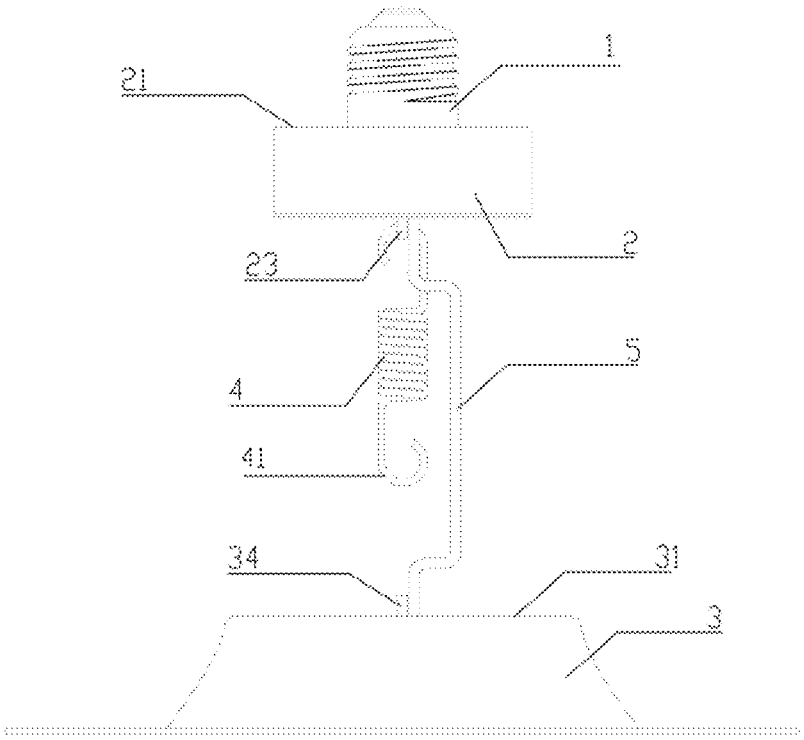
FIG. 1 is a front view of a split type downlight apparatus of preferred embodiment of the present invention.
Figure 2:
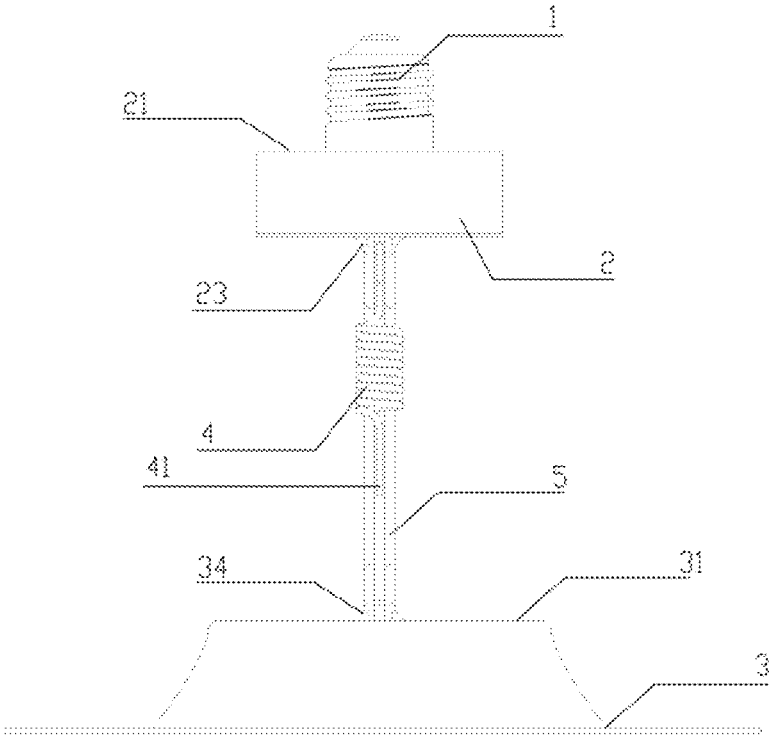
FIG. 2 is a side view of a split type downlight apparatus of preferred embodiment of the present invention.
Figure 3:
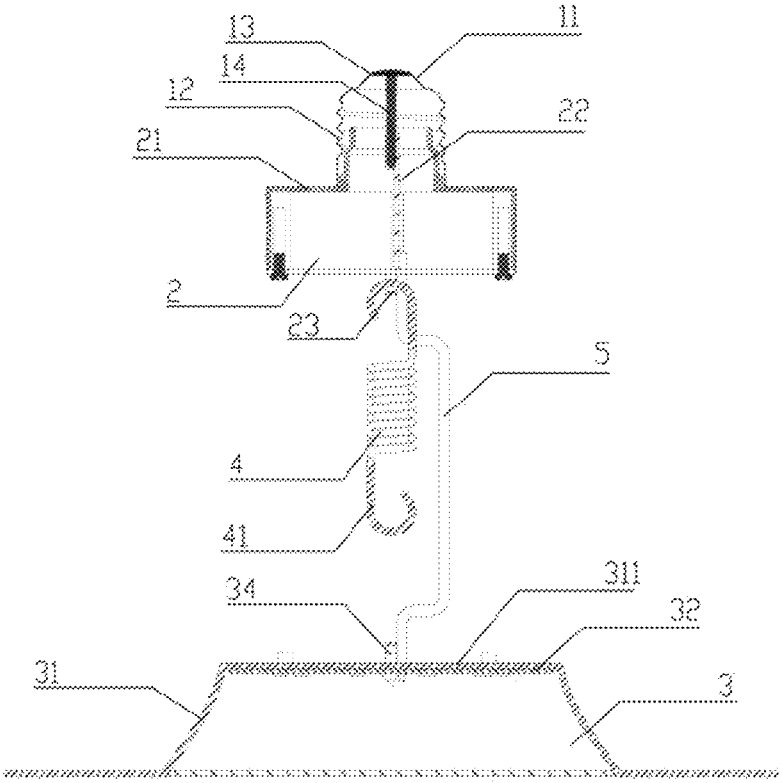
FIG. 3 is a perspective view of a split type downlight apparatus of preferred embodiment of the present invention.

Please refer to FIG. 1 to FIG. 3. FIG. 1 to FIG. 3 illustrates a split type downlight apparatus formed by a lamp cap 1, a driving component 2, a light body assembly 3, a spring 4 and an electrical connector 5. The driving component 2 includes a driving housing 21 and a driving board 22 fixed in the driving housing 21. The light body assembly 3 includes a light shell 31 and a light assembly 32 fixed in the light shell 31. One end of the electrical connector 5 electrically connects to the driving board 22. The other end of the electrical connector 5 electrically connects to the light assembly 32. Two ends of the spring 4 are hooked in the bottom of the driving housing 21 and the top of the light shell 31 respectively. The driving housing 21 connects to the light shell 31 through the spring 4.

The lamp cap 1 is fixed in the driving housing 21. The lamp cap 1 includes an insulating cap 11 set on the top and side walls 12 connected to the insulating cap 11. There is an assembling hole 13 on the central of the insulating cap 11. A conductive pin 14 is set in the lamp cap 1 through the assembling hole 13.

Besides, a positive pole terminal (not shown) and a negative pole terminal (not shown) are set on one end of the driving board 22. While assembling the lamp cap 1 and driving component 2, one end of the conductive pin 14 goes through the assembling hole 13 and electrically connects to the positive pole terminal (not shown). The other end of the conductive pin 14 is fixed on the top of the lamp cap 1. The negative pole terminal (not shown) electrically connects to the side walls 12 of the lamp cap.

Figure 4:
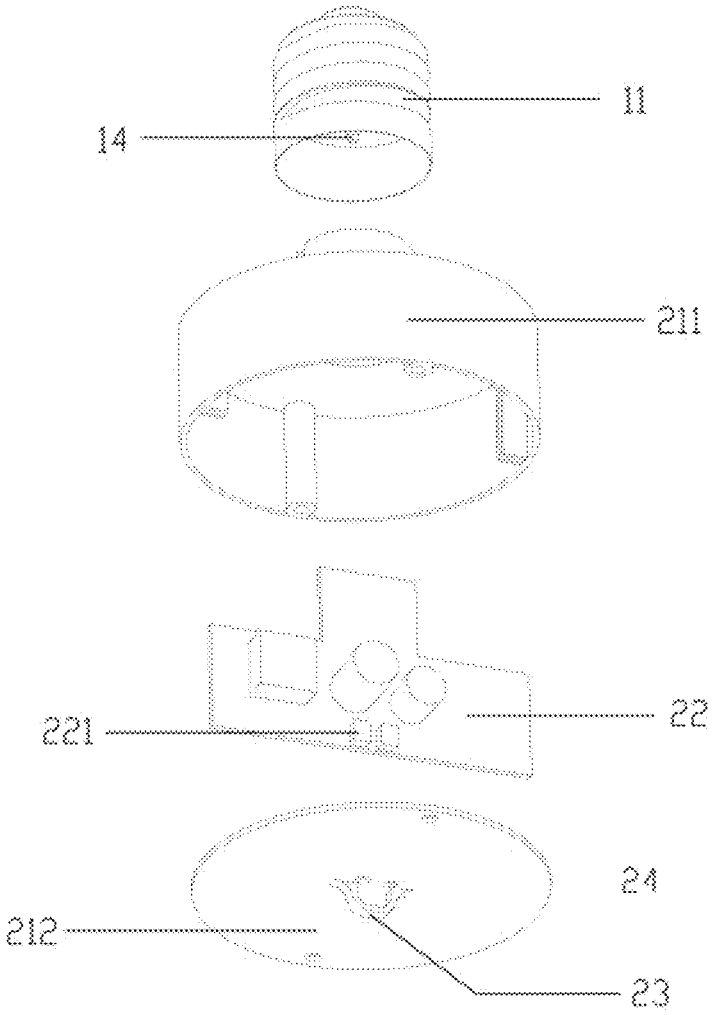
FIG. 4 is a three-dimensional schematic diagram of a driving component of a split type downlight apparatus.
Figure 6:
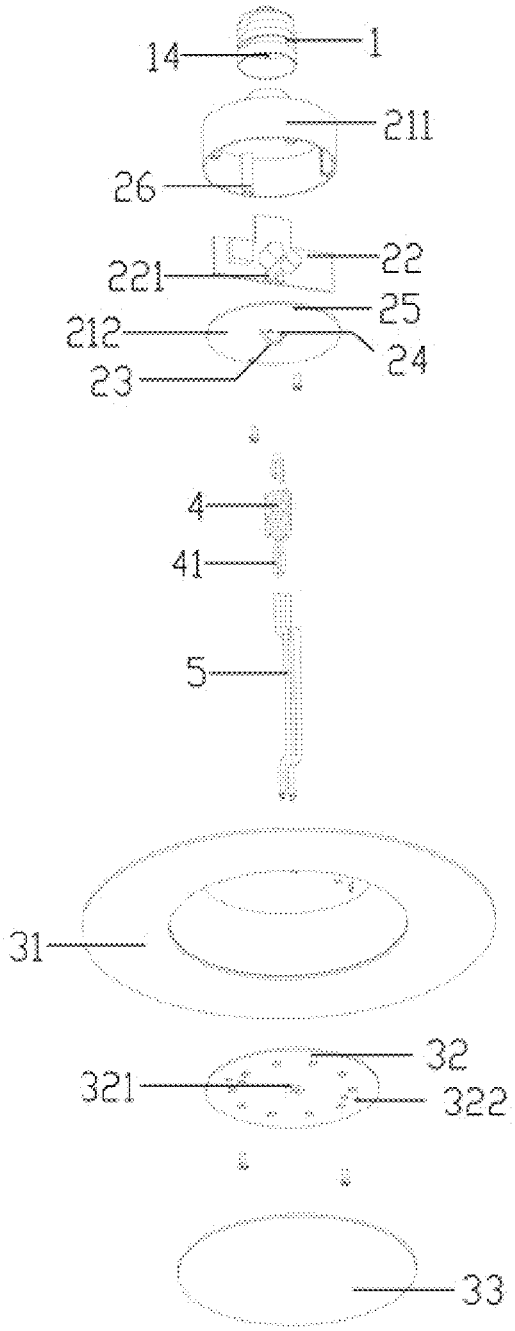
FIG. 6 is a three-dimensional schematic diagram of a split type downlight apparatus.
Figure 7:
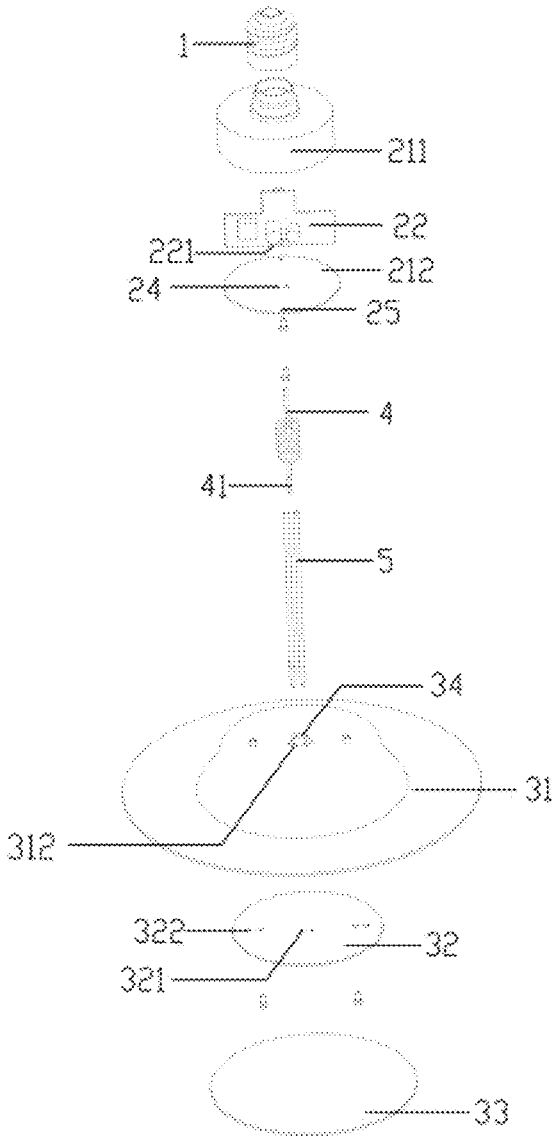
FIG. 7 is a three-dimensional schematic diagram of a split type downlight apparatus.

Please refer to FIG. 4, FIG. 6 and FIG. 7. The driving housing 21 includes an upper driving cover 211 and a lower driving cover 212. The upper driving cover 211 and the lower driving cover 212 form a space. The driving board 22 seated in the groove of upper driving cover 211 is fixed in the space. The lower driving cover 212 has a first hole 24. A lead terminal 221 is set in the driving board 22. One end of the electrical connector 5 goes through the first hole 24 and electrically connects to the lead terminal 221.

Figure 5:
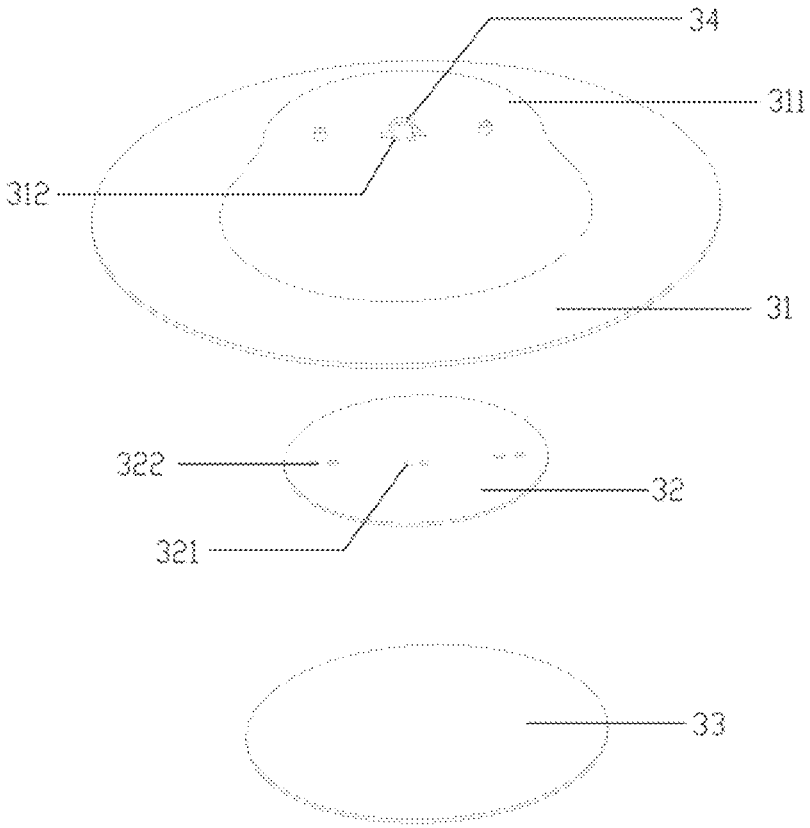
FIG. 5 is a three-dimensional schematic diagram of a light body assembly of a split type downlight apparatus.

Please refer to FIG. 3, FIG. 5 and FIG. 7. The light body assembly 3 includes a light shell 31, a light assembly 32 and a translucent cover 33. The light shell 31 has a space in which the light assembly 32 is fixed. The translucent cover 33 is fixed on the light shell 31. The translucent cover 33 seals the entrance of the space. A plate 311 is set on the top of the light shell 31. The plate 311 is provided with a second hole 312. The light assembly 32 is provided with an electrical terminal 321. The other end of the electrical connector 5 goes through the second hole 312 and electrically connects to the electrical terminal 321.

Please refer to FIG. 6 and FIG. 7. The upper driving cover 211 is provided with an internal screw-thread 26 for installation. The lower driving cover 212 is provided with an external screw-thread 25. The external screw-thread 25 corresponds to the internal screw-thread 26. The upper driving cover 211 is fixed to the lower driving cover 212 by matching the external screw-thread 25 and the internal screw-thread 26.

The light assembly 32 is provided with a threaded hole 322. A groove with an internal screw-thread is set in the light shell 31. A screw moves through the threaded hole 322 and is tightened on the groove. The light assembly 32 is fixed in the light shell 31 through this way.

Please refer to FIG. 1 to FIG. 7. In one embodiment, the lower driving cover 212 is provided with first fixing ring 23. The plate 311 of the light shell is provided with second fixing ring 34. The first fixing ring 23 is integrated formed with the lower driving cover 212, and the second fixing ring 34 is integrated formed with the plate 311. Two ends of the spring 4 are provided with hooks 41. The hooks 41 connect to the first fixing ring 23 of the lower driving cover 212 and second fixing ring 34 of the plate 311 of the light shell respectively. The driving housing 21 is fixed to the light shell 31 by hooks 41.

According to another embodiment of the present invention, a downlight apparatus has a driver module, a light module and a flexible component.

The driver module has a driver housing and a driver circuit. The driver circuit converts an external power to a driving current. The driver housing has a bottom cover.

The light module has a LED module, a light housing, and a front panel. The front panel has a surface ring with a top side facing to a ceiling to be installed. The front panel has an opening for outputting light of the LED module. The light housing has a top cover being kept a distance from the bottom cover of the driver housing when the downlight apparatus is installed.

The flexible component is used for connecting the top cover of the light housing and the bottom cover of the driver housing. The term flexible component means the distance and relative positions between the light module and the driver module may be changed when the downlight apparatus is not installed to a ceiling. Therefore, the flexible component may be a spring, a bendable metal bar, one or more than one wires.

Please be noted that in alternative embodiments, the flexible component may be replaced with a spaced bracket, which may still keep the driver module and the light module with a predetermined distance while performing well for heat dissipation. Such embodiments may be divided as a continuation application of this application.

For example, a bracket with several tubes is for keeping the light module and the driver module with a distance. Most part of the bracket is empty, thus air may be moved easily for better heat dissipation.

Such bracket may be detachable from either the light module or the driver module or may be detachable completely from the light module and the driver module.

An example of the light module may refer to the light body assembly, but not limit to the light body assembly as mentioned above. For example, the light module may have different LED arrangement, e.g. arranged in a lateral wall and using a light guide to change light paths to desired output direction.

An example of the driver module may refer to the components enclosed with the driving housing, but not necessary limit to those examples. For example, the driver module may not need a cap, like an Edison cap to be connected to an external power source.

In some embodiments, the flexible component may have one or more spring components. Other variation, like elastic bar, may also be used as an alternative option.

In some embodiments, the spring may have an external insulated layer and conductive material inside the external insulated layer for transmitting the driving current to the LED module. For example, electricity wires may be enclosed by elastic material to form the flexible component mentioned here. The electricity wires may be separately enclosed by insulated material and form multiple connections between the light module and the driver module. Such design increases robust connection between the driver module and the light module. Multiple wires may be enclosed at the same with insulated material.

In some other embodiments, in addition to the spring, there may be wires for transmitting electricity from the driver module to the light module.

In some embodiments, the top cover of the light module has a first socket for inserting a first terminal end of the wire. Also, the bottom cover of the driver module may have a second socket for inserting a second terminal end of the wire.

In such case, the flexible component is easily detachable from the light module and the driver module. During installation, users just need to plug the flexible component into the sockets of the light module and the driver module.

In some embodiments, the light module is detachable from the driver module and is the replaceable with another light module with a different output light characteristic. In other words, the same driver module may be used to match several different light modules and vice versa.

For example, users may buy several light modules with different light beam angles and replace a necessary light module to meet their needs.

On the other hand, the driver module may have different components, even having additional components like wireless transmitter, audio circuit and control circuit. In such case, the same light module may match to different driver modules that may have different pricing for different needs. Such design would reduce significantly the manufacturing and storing cost.

In some embodiments, the flexible component includes one or more wires for providing both structure connection and electrical connection between the light module and the driver module. In other words, compared with previous examples, the spring may even be reduced.

In some embodiments, the surface ring, i.e. the part that has its top side facing and touching the ceiling and having its bottom side facing downwardly to users, may have corresponding fixing structures, like screw holes, screws, clips or other fasteners to fix to the ceiling. When the bottom part of the downlight apparatus, i.e. the light module is fixed to the ceiling, and its top part, i.e. the driver module is fixed to a socket or an installation box, the connection between the light module and the driver module does not need strong structure connection, e.g. only for transmitting electricity. This makes the overall product more robust and meeting safety standards.

In some embodiments, since most space between the light module and the driver module is empty, protruding structures like fins may be installed on either the top cover of the light module and/or the bottom cover of the driver module for better heat dissipation.

In addition to the above described embodiments, various modifications may be made and within the spirit of the same invention, the various designs may be made by the skilled in the art are susceptible in the protection range of the present invention.

The invention claimed is:

1. A split type downlight apparatus, comprising:

a lamp cap;

a driving component;

a light body assembly;

a spring; and an electrical connector, wherein the driving component includes a driving housing and a driving board fixed in the driving housing, the lamp cap is fixed on the driving housing, the lamp cap electrically connects to the driving board;

the light body assembly includes a light shell and a light assembly fixed in the light shell, one end of the electrical connector electrically connects to the driving component, the other end of the electrical connector electrically connects to the light assembly, two ends of the spring are hooked in the bottom of the driving housing and the top of the light shell respectively, the driving housing connects to the light shell through the spring, wherein the light shell is detachable from the driving housing and is the replaceable with another light shell with a different beam angle.

2. The split type downlight apparatus of claim 1, wherein the driving housing includes an upper driving cover and a lower driving cover, the upper driving cover and the lower driving cover form a space, the driving board seated in the groove of upper driving cover is fixed in the space;

the lower driving cover has a first hole, a lead terminal is set in the driving board, one end of the electrical connector goes through the first hole and electrically connects to the lead terminal.

3. The split type downlight apparatus of claim 2, wherein the upper driving cover is provided with an external screw thread for fixing, the lower driving cover is provided with an internal screw thread hole, the internal screw thread hole corresponds to the external screw thread, the upper driving cover is fixed to the lower driving cover through corresponding of the external screw thread and the internal screw thread hole.

4. The split type downlight apparatus of claim 2, wherein the light body assembly includes a translucent cover, the light shell has a space in which the light assembly is fixed, the translucent cover is fixed on the light shell, the translucent cover seals the entrance of the space;

a plate with second hole is set on the top of the light shell, the light assembly is provided with an electrical terminal, the other end of the electrical connector goes through the second hole and electrically connects to the electrical terminal.

5. The split type downlight apparatus of claim 4, wherein the light assembly is provided with a threaded hole, a groove with an internal screw-thread is set in the light shell, a screw moves through the threaded hole and be tightened on the groove, the light assembly is fixed in the light shell through this way.

6. The split type downlight apparatus of claim 4, wherein the lower driving cover is provided with first fixing ring, the plate of the light shell is provided with second fixing ring, two ends of the spring are provided with hooks, two ends of the spring are hooked in the first fixing ring and second fixing ring respectively.

7. The split type downlight apparatus of claim 6, wherein the first fixing ring is integrated formed with the lower driving cover, and the second fixing ring is integrated formed with the plate.

8. The split type downlight apparatus of claim 1, wherein the lamp cap includes an insulating cap set on the top and side walls connected to the insulating cap, an assembling hole is set on the central of the insulating cap.

9. The split type downlight apparatus of claim 8, wherein a positive pole terminal and a negative pole terminal are set on one end of the driving board.

10. The split type downlight apparatus of claim 9, wherein a conductive pin is set in the lamp cap, one end of the conductive pin goes through the assembling hole and electrically connects to the positive pole terminal while assembling, the other end of the conductive pin is fixed on the top of the lamp cap, the negative pole terminal electrically connects to the side walls of the lamp cap.

11. A downlight apparatus, comprising:

a driver module having a driver housing and a driver circuit, the driver circuit converting an external power to a driving current, the driver housing having a bottom cover;

a light module comprising a LED module, a light housing, and a front panel, the front panel has a surface ring with a top side facing to a ceiling to be installed, the front panel having an opening for outputting light of the LED module, the light housing having a top cover being kept a distance from the bottom cover of the driver housing when the downlight apparatus is installed;

a flexible component for connecting the top cover of the light housing and the bottom cover of the driver housing, wherein the light module is detachable from the driver module and is the replaceable with another light module with a different beam angle.

12. The downlight apparatus of claim 11, wherein the flexible component comprises a spring.

13. The downlight apparatus of claim 12, wherein the spring has an external insulated layer and conductive material inside the external insulated layer for transmitting the driving current to the LED module.

14. The downlight apparatus of claim 12, further comprising a wire for transmitting the driver current to the LED module.

15. The downlight apparatus of claim 14, wherein the top cover of the light module has a first socket for inserting a first terminal end of the wire.

16. The downlight apparatus of claim 15, wherein the bottom cover of the driver module has a second socket for inserting a second terminal end of the wire.

17. The downlight apparatus of claim 11, wherein the flexible component comprises a wire for providing both structure connection and electrical connection between the light module and the driver module.

18. The downlight apparatus of claim 11, wherein the surface ring has a fixing structure for fixing the light module to the ceiling.

19. The downlight apparatus of claim 11, wherein the top cover of the light module has a protruding structure for heat dissipation.

* * * * *